US007086159B2

(12) United States Patent
Motta et al.

(10) Patent No.: US 7,086,159 B2
(45) Date of Patent: Aug. 8, 2006

(54) RAZOR ASSEMBLY

(75) Inventors: Vincent C. Motta, Norwalk, CT (US); Christine M. Ciccone, New Haven, CT (US); Andrew J. Pennella, Stamford, CT (US)

(73) Assignee: Eveready Battery Company, Inc., St. Louis, MO (US)

( * ) Notice: Subject to any disclaimer, the term of this patent is extended or adjusted under 35 U.S.C. 154(b) by 0 days.

(21) Appl. No.: 10/367,155

(22) Filed: Feb. 14, 2003

(65) Prior Publication Data

US 2003/0167644 A1 Sep. 11, 2003

Related U.S. Application Data

(63) Continuation-in-part of application No. 09/505,408, filed on Feb. 16, 2000, now Pat. No. 6,584,690.

(60) Provisional application No. 60/410,609, filed on Sep. 13, 2002.

(51) Int. Cl.
*B26B 21/00* (2006.01)

(52) U.S. Cl. ..... 30/526; 30/50

(58) Field of Classification Search ..... 30/41, 30/41.8, 43, 47, 49, 34.05, 123, 125, 537, 30/538, 400, 48, 50, 32, 526; 401/195, 42, 401/261, 25, 26, 27, 139
See application file for complete search history.

(56) References Cited

U.S. PATENT DOCUMENTS

| | | | | |
|---|---|---|---|---|
| 330,418 | A | 11/1885 | Partridge et al. | |
| 951,036 | A | 3/1910 | Waterman | |
| 1,342,028 | A | 6/1920 | Nordskog | |
| 1,543,387 | A | 6/1925 | Kawalle | |
| 1,744,280 | A | 1/1930 | Peterson | |
| 1,768,307 | A | 6/1930 | Bleloch et al. | |
| 1,836,800 | A | 12/1931 | Hope | |
| 2,183,554 | A | 12/1939 | Evans | 30/84 |
| 2,614,321 | A | 10/1952 | Ackeman | |
| 2,839,224 | A | 6/1958 | Lipka | |
| 3,378,922 | A | 4/1968 | Scjrader et al. | 30/66 |
| 3,477,127 | A * | 11/1969 | Regan | 30/41 |
| 3,488,764 | A | 1/1970 | Welsh | 30/50 |
| 3,675,323 | A | 7/1972 | Braginetz | 30/32 |
| 3,702,026 | A | 11/1972 | Scholin | |
| 3,703,764 | A | 11/1972 | Perry | 30/32 |
| 3,703,765 | A | 11/1972 | Perez | |
| 3,724,070 | A | 4/1973 | Dorion, Jr. | 30/47 |

(Continued)

FOREIGN PATENT DOCUMENTS

BE 509715 3/1952

(Continued)

OTHER PUBLICATIONS

Partial European Search Report, Serial No. 05103654.9-2313, Sep. 6, 2005.

(Continued)

*Primary Examiner*—Allan N. Shoap
*Assistant Examiner*—Ghassem Alie
(74) *Attorney, Agent, or Firm*—Michaud-Duffy Group LLP

(57) ABSTRACT

A razor assembly is provided that includes a handle having a cavity, a razor cartridge attached to a razor cartridge holder, and a shaving aid body. The razor cartridge holder is slidably received within the cavity of the handle. The shaving aid body is attached to the handle, and includes a contact surface and an aperture disposed in the contact surface that is sized to receive the razor cartridge. In some embodiments, one or more biasing members act between the handle and the razor cartridge holder.

14 Claims, 3 Drawing Sheets

U.S. PATENT DOCUMENTS

| | | | | |
|---|---|---|---|---|
| 3,786,563 | A | 1/1974 | Dorion, Jr. et al. | 30/50 |
| 3,832,774 | A | 9/1974 | Perry | 30/32 |
| 3,871,077 | A | 3/1975 | Nissen et al. | |
| 3,895,437 | A | 7/1975 | DiBuono | |
| 3,934,338 | A | 1/1976 | Braginetz | 30/47 |
| 3,935,639 | A | 2/1976 | Terry et al. | |
| 3,969,817 | A | 7/1976 | DiBuono | |
| 4,074,429 | A | 2/1978 | Roberts | |
| 4,170,821 | A | 10/1979 | Booth | |
| 4,241,500 | A | 12/1980 | Iten | |
| 4,314,404 | A | 2/1982 | Ruiz et al. | 30/41 |
| 4,336,651 | A | 6/1982 | Caro | 30/49 |
| 4,389,773 | A | 6/1983 | Nissen et al. | 30/49 |
| 4,407,067 | A | 10/1983 | Trotta | 30/50 |
| 4,442,598 | A | 4/1984 | Jacobson | 30/47 |
| 4,443,940 | A | 4/1984 | Francis et al. | 30/50 |
| 4,483,068 | A | 11/1984 | Clifford | |
| 4,534,110 | A | 8/1985 | Glass | 30/346.57 |
| 4,535,537 | A | 8/1985 | Ferraro et al. | 30/32 |
| 4,562,644 | A | 1/1986 | Hitchens | |
| 4,573,266 | A | 3/1986 | Jacobson | 30/41 |
| 4,586,255 | A | 5/1986 | Jacobson | 30/41 |
| 4,587,729 | A | 5/1986 | Jacobson | |
| 4,595,124 | A | 6/1986 | Duval et al. | |
| 4,621,424 | A | 11/1986 | Jacobson | 30/41 |
| 4,624,051 | A | 11/1986 | Apprille, Jr. et al. | 30/50 |
| 4,712,300 | A * | 12/1987 | Hemmeter | 30/41 |
| D298,068 | S | 10/1988 | Gilder | D28/47 |
| 4,778,640 | A | 10/1988 | Braun et al. | |
| 4,807,360 | A | 2/1989 | Cerier et al. | 30/49 |
| 4,850,106 | A | 7/1989 | Braun et al. | |
| 4,875,288 | A | 10/1989 | Trotta et al. | 30/49 |
| 4,893,641 | A | 1/1990 | Strickland | |
| 4,901,437 | A | 2/1990 | Iten | 30/50 |
| 4,944,090 | A * | 7/1990 | Sumnall | 30/41 |
| 4,964,214 | A | 10/1990 | Welsh et al. | |
| 4,970,784 | A | 11/1990 | Althaus et al. | 30/89 |
| 4,977,670 | A | 12/1990 | Iten | |
| 4,979,298 | A | 12/1990 | Pesiri | |
| 4,984,365 | A | 1/1991 | Leonard et al. | |
| 5,005,287 | A | 4/1991 | Ritter | 30/41 |
| 5,031,318 | A | 7/1991 | Brown et al. | |
| 5,036,587 | A | 8/1991 | Trotta et al. | |
| 5,056,222 | A | 10/1991 | Miller et al. | |
| 5,063,667 | A | 11/1991 | Jacobson | |
| 5,063,669 | A | 11/1991 | Althaus | 30/77 |
| 5,079,839 | A | 1/1992 | Conrad, Jr. et al. | |
| 5,084,968 | A | 2/1992 | Trotta | 30/47 |
| 5,121,541 | A | 6/1992 | Patrakis | |
| 5,134,775 | A | 8/1992 | Althaus et al. | |
| 5,141,349 | A | 8/1992 | Maguire, Jr. et al. | |
| 5,161,307 | A | 11/1992 | Althaus | 30/77 |
| 5,191,712 | A | 3/1993 | Crook et al. | 30/34.2 |
| 5,249,361 | A | 10/1993 | Apprille, Jr. et al. | 30/77 |
| 5,265,759 | A | 11/1993 | Coffin | 221/123 |
| 5,301,425 | A * | 4/1994 | Ferraro | 30/42 |
| 5,313,706 | A * | 5/1994 | Motta et al. | 30/57 |
| 5,319,852 | A | 6/1994 | Metzger | |
| 5,347,714 | A | 9/1994 | Prochaska | |
| 5,369,885 | A * | 12/1994 | Ferraro | 30/41 |
| 5,430,939 | A | 7/1995 | Johnston | 30/41 |
| 5,461,782 | A | 10/1995 | Rauch | |
| 5,463,813 | A | 11/1995 | Otsuka et al. | 30/43.9 |
| 5,490,329 | A | 2/1996 | Chylinski et al. | |
| 5,493,778 | A | 2/1996 | Ichiyanagi | |
| 5,497,550 | A | 3/1996 | Trotta et al. | 30/50 |
| 5,517,760 | A | 5/1996 | Prochaska | |
| D373,218 | S | 8/1996 | Shurtleff et al. | D28/44 |
| 5,579,580 | A | 12/1996 | Althaus et al. | |
| 5,604,983 | A | 2/1997 | Simms et al. | |
| 5,626,154 | A | 5/1997 | Rogers et al. | |
| 5,666,729 | A | 9/1997 | Ferraro | 30/50 |
| 5,711,076 | A | 1/1998 | Yin et al. | |
| D403,811 | S | 1/1999 | Brown et al. | D28/47 |
| 5,903,979 | A * | 5/1999 | Oldroyd | 30/41 |
| 5,953,825 | A | 9/1999 | Christman et al. | 30/527 |
| 5,956,849 | A | 9/1999 | Chadwick et al. | |
| D415,315 | S | 10/1999 | Swanson et al. | D28/47 |
| D416,108 | S | 11/1999 | Shurtleff et al. | |
| 6,161,287 | A | 12/2000 | Swanson et al. | |
| 6,185,823 | B1 | 2/2001 | Brown et al. | |
| 6,295,734 | B1 | 10/2001 | Gilder et al. | 30/50 |
| 6,298,557 | B1 | 10/2001 | Gilder et al. | 30/34.2 |
| 6,298,558 | B1 | 10/2001 | Tseng et al. | 30/41 |
| 6,308,416 | B1 | 10/2001 | Bosy et al. | 30/50 |
| 6,502,318 | B1 | 1/2003 | Gilder | 30/530 |
| 6,516,518 | B1 * | 2/2003 | Garraway et al. | 30/34.2 |
| 6,568,082 | B1 * | 5/2003 | Pouettre et al. | 30/41 |
| 6,584,690 | B1 | 7/2003 | Orloff et al. | |
| 2003/0014866 | A1 * | 1/2003 | Orloff et al. | 30/41 |

FOREIGN PATENT DOCUMENTS

| | | |
|---|---|---|
| DE | 319832 | 2/1919 |
| DE | 87 17 729.3 | 9/1989 |
| EP | 0 276 066 | 1/1988 |
| EP | 0 477 132 B1 | 3/1992 |
| EP | 0 453 906 B1 | 11/1992 |
| EP | 1 125 697 A1 | 8/2001 |
| EP | 1157792 A | 11/2001 |
| FR | 482 302 | 3/1917 |
| FR | 806 899 | 12/1936 |
| FR | 1484360 | 6/1967 |
| FR | 1 503 887 | 12/1967 |
| GB | 14517 A | 2/1916 |
| GB | 327054 A | 3/1930 |
| GB | 409 902 | 5/1934 |
| GB | 1 432 182 | 4/1976 |
| GB | 2 042 959 A | 10/1980 |
| GB | 2116470 | 9/1983 |
| JP | 4-361783 | 12/1992 |
| WO | WO 91/01204 | 2/1991 |
| WO | WO 96/02369 | 2/1996 |
| WO | 98/36878 | 8/1998 |

OTHER PUBLICATIONS

European Search Report EP 01300318 dated May 23, 2001.
Copy of PCT Search Report for Serial No. PCT/IB03/01144 dated Oct. 29, 2003.

* cited by examiner

RAZOR ASSEMBLY

This application is a continuation-in-part of U.S. Pat. application Ser. No. 09/505,408 filed on Feb. 16, 2000, now U.S. Pat. No. 6,584,690, and also claims the benefit of and incorporates by reference essential subject matter disclosed in U.S. Provisional Patent Application No. 60/410,609 filed on Sep. 13, 2002.

BACKGROUND OF THE INVENTION

1. Technical Field

This invention relates to shaving devices in general, and to shaving devices that include a shaving aid in addition to one or more razor blades in particular.

2. Background Information

Modern safety razors include a plurality of razor blades disposed within a cartridge that is pivotally or rigidly mounted on a handle. Each of the razor blades has a cutting edge that is contiguous with a shave plane. Some safety razors (also referred to hereinafter as razor assemblies) have a disposable cartridge for use with a reusable handle, while others have a handle and cartridge that are combined into a unitary disposable. Razor cartridges often include a thin strip comprised of shaving aids (e.g., lubricating agents, drag reducing agents, depilatory agents, cleaning agents, medicinal agents, etc.) disposed aft of the razor blades to enhance the shaving process. The strip is positionally fixed relative to the razor blades. The terms "forward" and "aft", as used herein, define relative position between features of the safety razor. A feature "forward" of the razor blades, for example, is positioned so that the surface to be shaved encounters the feature before it encounters the razor blades, if the razor assembly is being stroked in its intended cutting direction (e.g., a guard is typically disposed forward of the razor blades). A feature "aft" of the razor blades is positioned so that the surface to be shaved encounters the feature after it encounters the razor blades, if the razor assembly is being stroked in its intended cutting direction (e.g., the aforesaid shaving aid strip disposed aft of the razor blades).

Most safety razors are designed for use with a shaving preparation. The shaving preparation (e.g., shaving cream) is applied to the skin and remains there until it is removed during the shaving process, or washed off thereafter. Although shaving preparations desirably enhance the shaving process, there are undesirable aspects associated therewith. For example, shaving cream is impractical in a wet shaving environment because the shaving cream is often washed away before the shaving process can be completed. In addition, shaving cream is an item independent of the razor that must be purchased and stored by the user; i.e., one more item to store in the bathroom.

What is needed, therefore, is a razor assembly that can be used with a shaving preparation without the above-identified problems, and one that can be used in a shower/wet environment.

DISCLOSURE OF THE INVENTION

According to the present invention, a razor assembly is provided that includes a handle, a razor cartridge, a razor cartridge holder, and a shaving aid body. The shaving aid body is an oval shaped body that has a center aperture sized to receive the razor cartridge. The shaving aid body is attached to the handle. The razor cartridge is attached to the razor cartridge holder. In some embodiments, one or more biasing members are used to maintain the position of the razor cartridge and holder relative to the handle (and vice versa) during normal shaving operation. In other embodiments, the operator herself maintains the position of the razor cartridge and holder relative to the handle (and vice versa) during normal shaving operation.

An advantage of the present invention is the ease of use and safety that result from the adjustable positioning of the razor cartridge relative to the shaving aid body possible with the present invention. During normal shaving operation, the razor cartridge remains substantially aligned with the contact surface of the shaving aid body. In some embodiments an actuator is included. The actuator provides the operator with a mechanism for increasing the height of the razor cartridge for purposes of changing the shave characteristics, or to replace the razor cartridge, etc.

Another advantage of the present invention is that a shaving aid can be put on during the process of shaving. As a result, the shaving aid within the shaving aid body can be successfully applied and utilized within a wet shaving environment. The need for an independent source of shaving cream or other shaving preparation, and the clutter and mess associated therewith, can consequently be eliminated.

Another advantage of the present invention is its simplicity. The present invention provides a device that can adjust the position of the razor cartridge relative to the contact surface of the shaving aid body. It does so with a simple mechanism that is easy and cost effective to produce.

These and other objects, features, and advantages of the present invention will become apparent in light of the detailed description of the present invention.

DETAILED DESCRIPTION OF THE INVENTION

Figure 1:
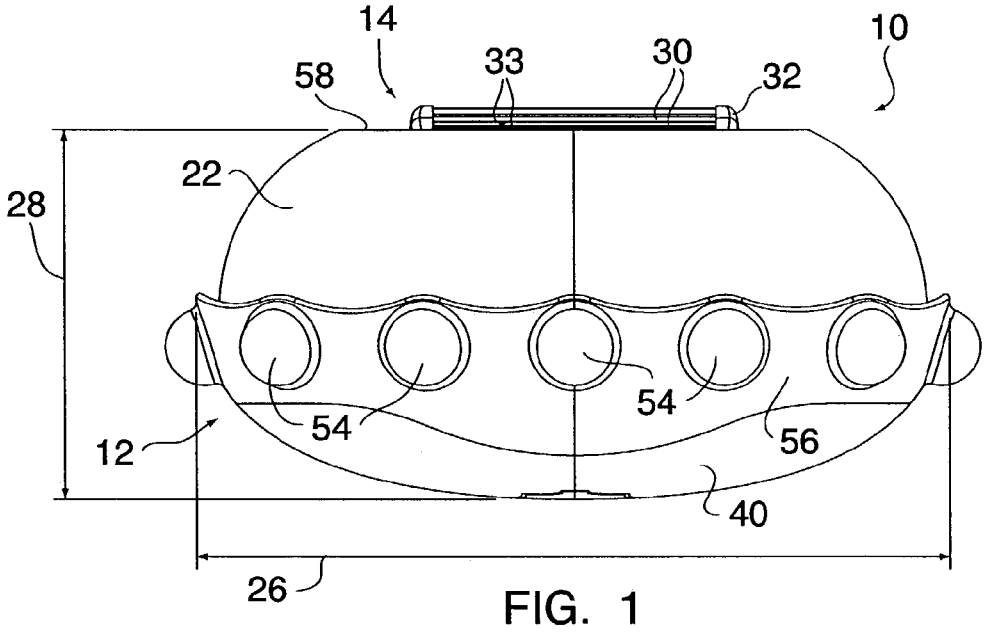
FIG. 1 is a side view of the present invention razor assembly.
Figure 2:
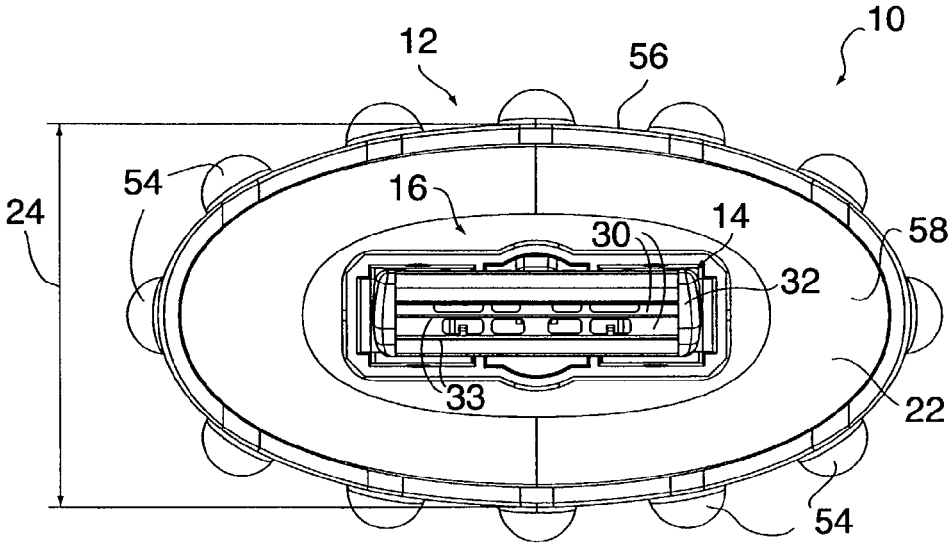
FIG. 2 is a top view of the present invention razor assembly.

Referring to FIGS. 1–7, the present invention razor assembly 10 includes a handle 12, a razor cartridge 14, a razor cartridge holder 16 (see FIGS. 3–6), and a shaving aid body 22 having a center aperture 23. Some embodiments of the razor assembly further include one or more guide members 18, and one or more biasing members 20. The razor assembly 10 can be described as having a width 24, a length 26, and a height 28. At least a portion of the razor cartridge 14 and the razor cartridge holder 16 are slidably received within the center aperture 23 of the shaving aid body 22.

The razor cartridge 14 includes one or more razor blades 30 attached to a frame 32. Each of the razor blades 30 has a lengthwise extending cutting edge 33. A variety of razor cartridges 14 can be used with the present invention razor assembly 10. The razor assembly 10 is not, therefore, limited to any particular razor cartridge 14. The razor cartridge 14 is attached to the razor cartridge holder 16.

The razor cartridge holder 16 includes a pair of attachment brackets 34 extending out from an upper panel 36. The attachment brackets 34 have features (male and/or female) that are operable to attach the razor cartridge 14 to the holder 16 in a fixed or pivotable manner. The attachment brackets 34 represent one of a variety of different attachment mechanisms that can be used to attach the razor cartridge 14 to the razor cartridge holder 16. The present invention is not, therefore, limited to any particular attachment.

The shaving aid body 22, which includes a contact surface 58, is an erodable solid body that comprises one or more shaving aid materials (e.g., lubricating agents, drag reducing agents, depilatory agents, cleaning agents, medicinal agents, etc.) to enhance the shaving process. The shaving aid body 22 is not limited to any particular type of shaving aid material, but rather can be selectively formulated to suit the application at hand. A solid soap material is an example of an acceptable shaving aid material for use in a wet shaving environment. In FIGS. 1–6, the shaving aid body 22 is shown as a one-piece oval having a center aperture 23. In alternative embodiments, the shaving aid body 22 can comprise one or more portions positioned adjacent the razor cartridge 14; e.g., a forward portion, an aft portion, and/or side portions. The shaving aid body 22 is attached to the handle 12. In some embodiments, the shaving aid body 22 is a replaceable cartridge that can be selectively attached to and detached from the handle 12. The shaving aid body 22 may be attached to a base 25 (see FIG. 7).

The handle 12 includes a wall 40, a cavity 45, and outer panels 44. The outer panels 44 are spaced apart a distance sufficient to receive the razor cartridge holder 16. The handle wall 40 is preferably ergonomically shaped, and/or has features 54 that create an ergonomic shape, to facilitate gripping the razor assembly 10. The handle 12 may include a grip sleeve 56 attached to the wall 40. The grip sleeve 56 includes a material (e.g., rubber) and/or features to facilitate gripping the handle 12. The aperture 46 is aligned between the inner panels 42.

In some embodiments, the present invention razor assembly includes one or more biasing members 20 and/or one or more guide members 18. The one or more biasing members 20 are attached to one of the handle 12 or the razor cartridge holder 16, and act against the other of the handle 12 and razor cartridge holder 16. The one or more guide members 18 are attached to one or both of the handle 12 or the razor cartridge holder 16 for guiding relative movement between the handle 12 and razor cartridge holder 16. The one or more guide members 18 and the one or more biasing members 20 are described below in the context of the embodiments shown in FIGS. 1–7.

Figure 3:
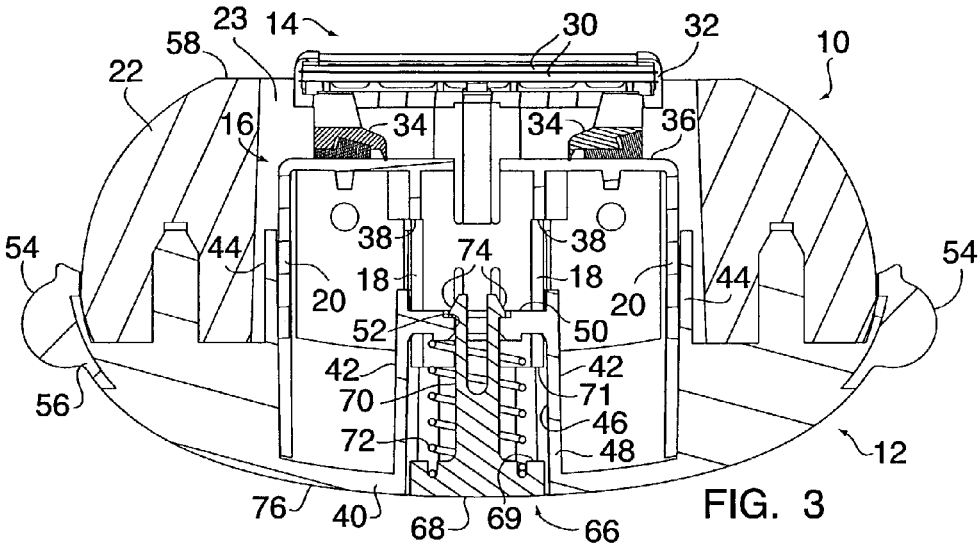
FIG. 3 is a diagrammatic sectional view of the present invention razor assembly, showing the actuator in an unactuated position with the razor cartridge adjacent the contact surface of the shaving aid body.
Figure 4:
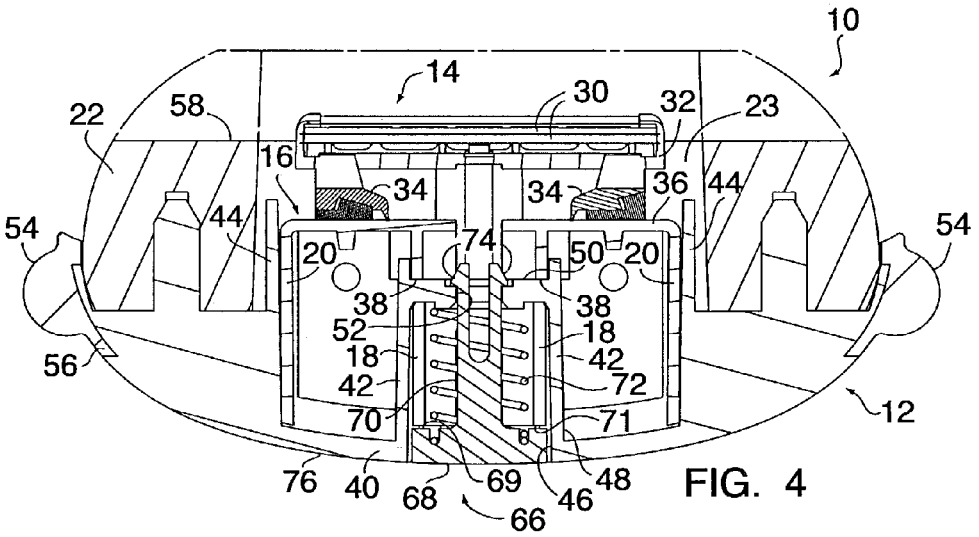
FIG. 4 is a diagrammatic sectional view of the present invention razor assembly, showing the actuator in an unactuated position with the razor cartridge disposed below the contact surface of the shaving aid body.
Figure 5:
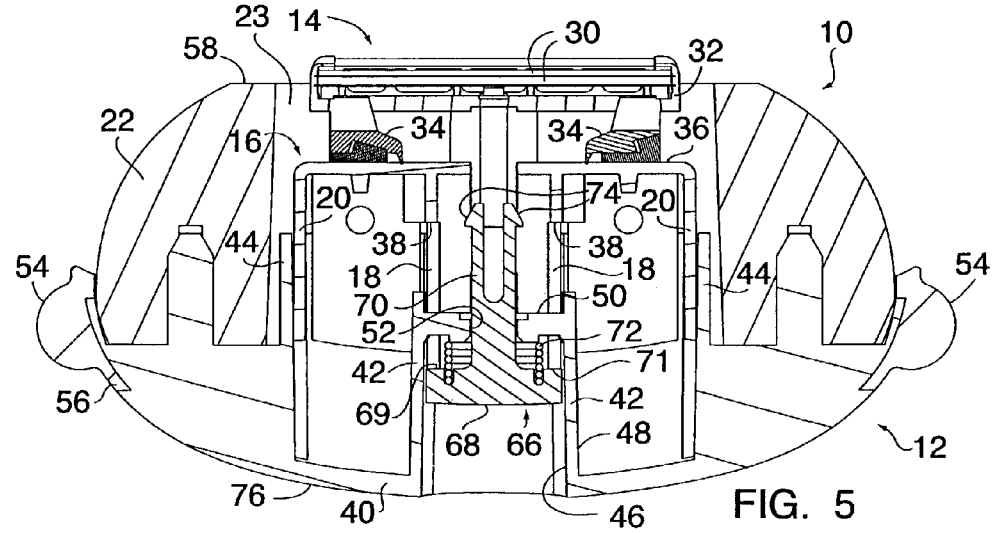
FIG. 5 is a diagrammatic sectional view of the present invention razor assembly, showing the actuator in an actuated position.

In the embodiment shown in FIGS. 3–5, the razor cartridge holder 16 includes a pair of guide members 18 and a pair of biasing members 20. The guides 18 are parallel and spaced apart from one another, and are attached to the upper panel 36. Each guide 18 also includes a stop tab 38 located adjacent the upper panel 36. The biasing members 20 are attached to, and cantilevered out from, the upper panel 36. The handle 12 includes a pair of inner panels 42, and an aperture 46 disposed in a base portion 48 of the wall 40. The outer panels 44 are spaced apart a distance sufficient to receive the biasing members 20. The inner panels 42 are spaced apart a distance sufficient to receive the guide members 18 of the razor cartridge holder 16. A cross member 50 having an aperture 52 extends between the inner panels 42.

The embodiment shown in FIGS. 3–5 further includes an actuator 66 to facilitate moving the razor cartridge 14 relative to the shaving aid body 22. The actuator 66 is operable to move one of the razor cartridge holder 16 and the handle 12 relative to the other. The actuator 66 shown in FIGS. 3–5 is mounted on the handle 12 and includes a pad 68, a stem 70, and a spring 72. The pad 68 is attached to one end of the stem 70 and one or more tabs 74 are attached to the other end of the stem 70. The stem 70 extends through the aperture 52 disposed within the cross member 50 that extends between the inner panels 42. The spring 72 surrounds the stem 70 and acts between the pad 68 and the cross member 50. The one or more tabs 74 attached to the stem 70 keep the stem 70 coupled to the handle 12. The pad 68 is located within the aperture 46 disposed within the base portion 48 of the handle 12. When the actuator 66 is in an unactuated position (FIGS. 3 and 4), the pad 68 is located approximately at the outer surface 76 of the handle 12 and the spring 72 is either not compressed or is only slightly compressed.

Figure 6:
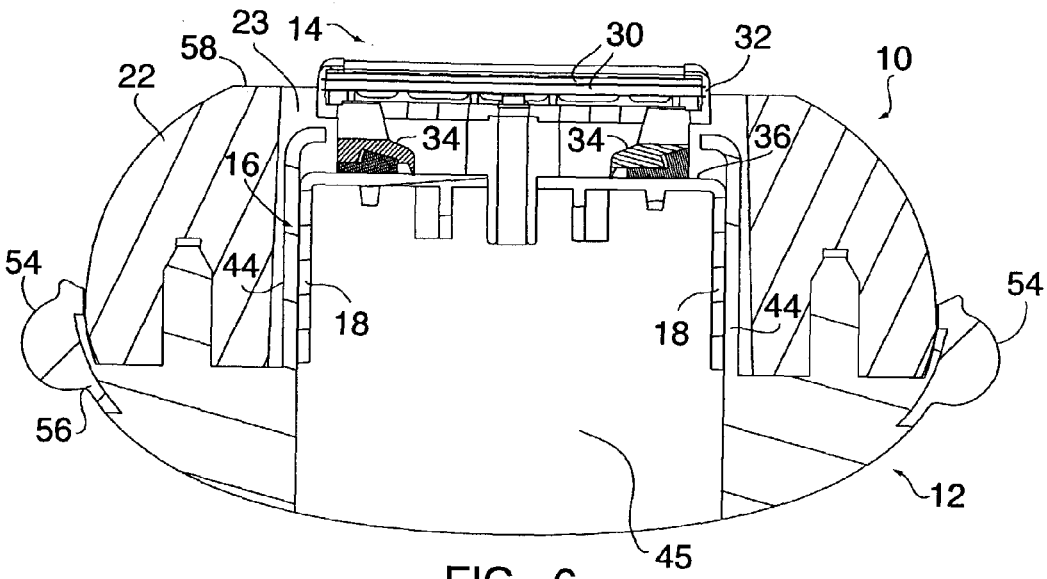
FIG. 6 is a diagrammatic sectional view of an embodiment of the present invention razor assembly.

In the embodiment shown in FIG. 6, the razor cartridge holder 16 includes a pair of guide members 18 attached to the ends of the upper panel 36. The guide members18 are substantially parallel and spaced apart from one another. The cavity 45 within the handle is substantially open to the base portion 48 of the wall 40. The outer panels 44 are spaced apart a distance sufficient to receive the guide members 18. In an alternative embodiment shown in FIG. 7, biasing members 20 can be used with, or in place of, the guide members 18.

The present invention is not limited to the biasing member 20 embodiments described above. For example, a single biasing member 20 or more than two biasing members 20 can be used, and/or each biasing member 20 can be configured in a shape other than a cantilever. In addition, the one or more biasing members 20 can alternatively be attached to the handle 12 and act on the razor cartridge holder 16.

The present invention is also not limited to the razor cartridge holder 16 and the handle 12 structures describe above. For example in the embodiment shown in FIGS. 3–5, the relative positions of the outer panels 44 and biasing members 20, and inner panels 42 and guide members 18 can be reversed; e.g., the biasing members 20 can be disposed of outside the outer panels 44. In addition, the biasing function of the one or more biasing members 20 can be provided by other means; e.g., the razor cartridge holder 16 and the outer panels 44 of the handle 12 can be sized such that when one is received within the other, a slight interference fit results.

When the razor assembly 10 is assembled, at least a portion of the razor cartridge 14 and the razor cartridge holder 16 are slidably disposed within the center aperture 23 of the shaving aid body 22 and the cavity 45 of the handle 12. In the embodiment shown in FIGS. 3–5 and 7, the biasing members 20 of the razor cartridge holder 16 act against the outer panels 44 of the handle 12. The product of the force of the biasing members 20 acting against the outer panels 44 and the coefficient of friction of the surfaces creates a frictional force that maintains the relative positions of the razor cartridge holder 16 and the handle 12 during normal shaving operation; i.e., the biasing force is sufficient to selectively prevent movement between the razor cartridge holder 16 and the handle 12. A force applied to the razor cartridge 14 that is great enough to overcome the sum of the frictional forces will cause relative motion between the razor cartridge holder 16 and the guide members 18, and thereby permit positional adjustment. In the embodiment shown in FIG. 6, the razor cartridge holder 16 is not biased between the outer panels 44 of the handle 12 and is consequently free to move within the cavity 45. The operator positions the razor cartridge holder and razor cartridge relative to the shaving aid body.

Referring to FIGS. 1–7, during operation of the razor assembly 10 the razor cartridge 14 is initially positioned such that the cutting edges 33 of the one or more razor blades 30 within the razor cartridge 14 are approximately coplanar with the contact surface 58 of the shaving aid body 22. During use, the razor assembly 10 is exposed to water and the razor assembly 10 is drawn along the surface to be shaved. The shaving aid body 22 consequently erodes and provides, for example, a lubricant for the surface to be shaved. In the an embodiment where the shaving aid body 22 is an oval body that surrounds the razor cartridge 14, the shaving aid body 22 deposits shaving aid material regardless of the user's stroke direction. As the operator shaves, the erosion of the shaving aid body 22 causes the body 22 to decrease in height (see FIG. 4). Absent a mechanism to account for the change in height to the shaving aid body 22, the razor cartridge 14 would soon be exposed and the lubricating function provided by the shaving aid body 22, inter alia, would be inhibited.

The present invention razor assembly 10 advantageously enables the shaving aid body 22 and razor cartridge 14 to maintain the original orientation between the contact surface 58 of the shaving aid body 22 and the razor blades 30 of the razor cartridge 14. During normal operation, the force applied to the razor assembly 10 by the operator is distributed partially on the razor cartridge 14 and partially on the shaving aid body 22. In some embodiments (FIGS. 3–5 and 7), the shaving aid body 22 erodes around the razor cartridge 14 and the force increases on the razor cartridge 14 until the frictional force between the biasing members 20 and the outer panels 44 is overcome by the operator force on the razor cartridge 14. Once the operator force exceeds the frictional force, the razor cartridge 14 and razor cartridge holder 16 recede by slidably traveling within the shaving aid body aperture 46. The razor cartridge 14 moves until it becomes substantially co-planar with the contact surface 58 of the shaving aid body 22. As a result, a portion of the operator force is redistributed to the shaving aid body 22, and the applied force to the razor cartridge 14 drops below the frictional force between the biasing members 20 and the outer panels 44. Consequently, the razor cartridge holder 16 and razor cartridge 14 assume a fixed position relative to the handle 12 and shaving aid body 22 attached thereto. In other embodiments (FIG. 6), the razor cartridge 14 and razor cartridge holder 16 are held in place relative to the shaving aid body 22 by the operator 22.

Referring to FIGS. 3–5, in the event the operator wishes to move the razor cartridge 14 toward the shaving aid body contact surface 58 (e.g., to adjust the shave characteristics, or to replace the razor cartridge), the operator pushes the actuator pad 68 into the handle 12. At some point in the travel of the pad 68, a surface 69 of the pad 68 contacts a surface 71 of one or both inner panels 42 of the razor cartridge holder 16. Pushing the actuator 66 further causes the razor cartridge holder 16 and attached razor cartridge 14 to slidably travel in the same direction. If the actuator 66 is pushed far enough, the razor cartridge 14 can be moved to a position at least partially above the contact surface 58. The spring 72 mounted around the stem 70 resists the movement of the actuator 66 and returns the stem 70 to its unactuated position upon completion of the adjustment.

Figure 7:
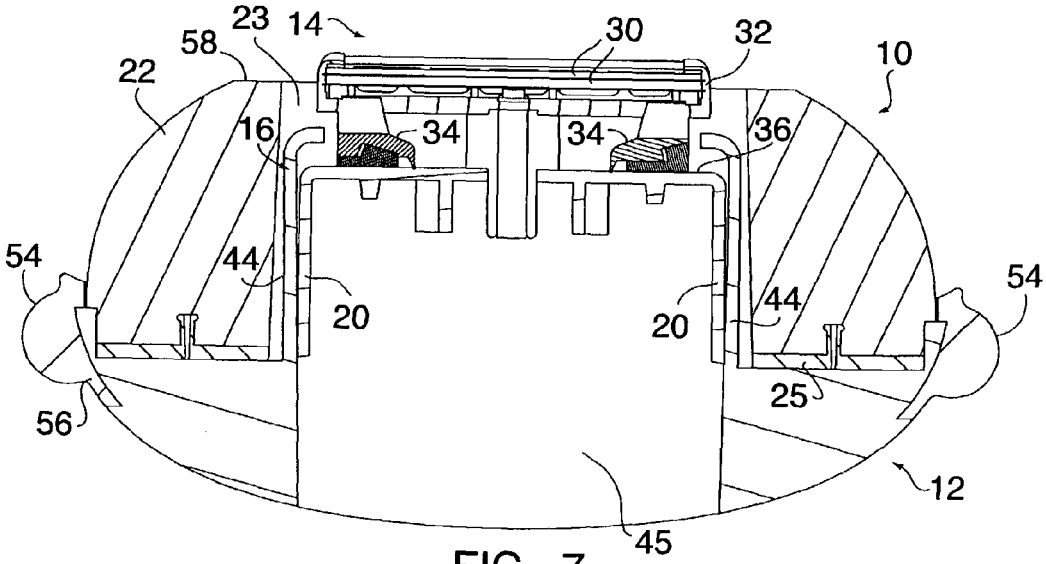
FIG. 7 is a diagrammatic sectional view of an embodiment of the present invention razor assembly.

Referring to the embodiments shown in FIGS. 6 and 7, if the operator wishes to move the razor cartridge, for example, toward the shaving aid body contact surface 58, the operator pushes the razor cartridge holder 16 up by inserting one or more digits into the cavity 45 and pushing up on the razor cartridge holder 16. In the embodiment of FIG. 7, the biasing members 20 will operate to maintain the razor cartridge holder 16 and razor cartridge 14 in the position selected by the operator. In the embodiment of FIG. 6, the operator maintains the position of the razor cartridge holder 16 and razor cartridge 14.

In an embodiment of the present razor assembly, the razor assembly is assembled so that it floats within water. The buoyancy of the razor assembly can be achieved by using buoyant materials or by including sealed voids within the structure, or some combination thereof.

The razor cartridge 14 and razor cartridge holder 16 can be provided together as a replacement cartridge that can be selectively attached and detached from the razor assembly 10, or as individual components. As stated above, the shaving aid body 22 can also be provided as a replacement cartridge that attaches directly to the handle 12. To facilitate handling and/or attachment of the shaving aid body 22 to the handle 12, a substantially rigid base may be attached to the shaving aid body. U.S. Pat. application Ser. No. 10/367,133 filed Feb. 14, 2003, hereby incorporated by reference, discloses such a base.

Although this invention has been shown and described with respect to the detailed embodiments thereof, it will be understood by those skilled in the art that various changes in form and detail thereof may be made without departing from the spirit and scope of the invention. For example, the present razor assembly is described above in terms of a razor cartridge movable with respect to a handle and a shaving aid body attached to the handle. In an alternative embodiment, the razor assembly can include a shaving aid body slidably mounted on a handle, which shaving aid body includes a contact surface and a center aperture disposed in the contact surface, and a razor cartridge attached to the handle that is disposed within the center aperture. The shaving aid body is selectively movable to adjust the position of the contact surface relative to the razor cartridge. In some embodiments, the razor assembly further includes one or more biasing members acting between the handle and the shaving aid body. The one or more biasing members provide sufficient force to selectively prevent relative movement between the handle and the shaving aid body.

What is claimed is:

1. A razor assembly that includes a razor cartridge having one or more razor blades, the razor assembly comprising:

a handle;

a razor cartridge holder, wherein the razor cartridge is selectively attached to the razor cartridge holder;

one or more guide members attached to one or both of the handle and the razor cartridge holder for guiding relative movement between the handle and razor cartridge holder;

one or more biasing members attached to one or both of the handle and the razor cartridge holder and acting against the other of the handle or razor cartridge holder, wherein the one or more biasing members provide sufficient frictional force against the other of the handle or razor cartridge holder to selectively prevent relative movement between the razor cartridge holder and handle; and a shaving aid body having an aperture sized to receive the razor cartridge, the shaving aid body being an erodable soap material, wherein the shaving aid body is attached to the handle.

2. The razor assembly of claim 1, wherein the one or more guide members include at least one guide member attached to the handle and at least one guide member attached to the razor cartridge holder, wherein the guide members attached to the handle and the razor cartridge holder mate with one another.

3. The razor assembly of claim 2, wherein the at least one guide member attached to the razor cartridge holder comprises a plurality of guide panels attached to an upper panel of the razor cartridge holder.

4. The razor assembly of claim 3, wherein the at least one guide member attached to the handle comprises a plurality of inner panels attached to the handle, wherein the inner panels and the guide panels mate with one another.

5. The razor assembly of claim 4, wherein the one or more biasing members are attached to the razor cartridge holder, and act against one or more outer panels attached to the handle.

6. The razor assembly of claim 5, wherein the biasing members cantilever out from the upper panel of the razor cartridge holder.

7. The razor assembly of claim 6, further comprising an actuator that is selectively operable to create relative movement between the razor cartridge holder and the handle.

8. The razor assembly of claim 7, wherein the actuator comprises a stem, a pad attached to a first end of the stem, one or more tabs attached to a second end of the stem, and a spring acting between the pad and the handle;

wherein the actuator is mounted on the handle and aligned with the razor cartridge holder, wherein the actuator enables an operator to move the razor cartridge holder relative to the handle.

9. The razor assembly of claim 8, wherein the handle includes an aperture large enough to receive a digit of the operator's hand, and the actuator is disposed within the aperture.

10. The razor assembly of claim 1, further comprising an actuator that is selectively operable to create relative movement between the razor cartridge holder and the handle.

11. The razor assembly of claim 10, wherein the actuator comprises a stem, a pad attached to a first end of the stem, one or more tabs attached to a second end of the stem, and a spring acting between the pad and the handle;

wherein the actuator is mounted on the handle and aligned with the razor cartridge holder, wherein the actuator enables an operator to move the razor cartridge holder relative to the handle.

12. The razor assembly of claim 11, wherein the handle includes an aperture large enough to receive a digit of the operator's hand, and the actuator is disposed within the aperture.

13. A razor assembly that includes a razor cartridge having one or more razor blades, the razor assembly comprising:

a handle;

a razor cartridge holder, wherein the razor cartridge is selectively attached to the razor cartridge holder;

one or more biasing members attached to the handle or the razor cartridge holder, and acting against the other of the handle or razor cartridge holder, wherein the one or more biasing members provide sufficient frictional force against the other of the handle or razor cartridge holder to selectively prevent relative movement between the razor cartridge holder and handle; and a shaving aid body having an aperture sized to receive the razor cartridge, wherein the shaving aid body is attached to the handle, the shaving aid body being an erodable soap material.

14. The razor assembly of claim 1, wherein the razor assembly floats in water.

* * * * *